US007285710B1

(12) United States Patent
Wallace

(10) Patent No.: US 7,285,710 B1
(45) Date of Patent: Oct. 23, 2007

(54) MUSICAL INSTRUMENT TUNER

(76) Inventor: Henry Burnett Wallace, 562 Oak Hill Rd., Fincastle, VA (US) 24090

( * ) Notice: Subject to any disclaimer, the term of this patent is extended or adjusted under 35 U.S.C. 154(b) by 45 days.

(21) Appl. No.: 11/311,519

(22) Filed: Dec. 19, 2005

Related U.S. Application Data

(60) Provisional application No. 60/641,257, filed on Jan. 4, 2005.

(51) Int. Cl.
*G10G 7/02* (2006.01)

(52) U.S. Cl. ..... 84/454

(58) Field of Classification Search ..... 84/454, 84/DIG. 18
See application file for complete search history.

(56) References Cited

U.S. PATENT DOCUMENTS

| | | | | | |
|---|---|---|---|---|---|
| 4,018,124 | A | | 4/1977 | Rosado | |
| 4,041,832 | A | | 8/1977 | Risch | |
| 4,163,408 | A | | 8/1979 | Capano et al. | |
| 4,365,537 | A | * | 12/1982 | Pogoda | 84/454 |
| 5,018,428 | A | * | 5/1991 | Uchiyama et al. | 84/616 |
| 5,070,754 | A | | 12/1991 | Adamson | |
| 5,349,130 | A | * | 9/1994 | Iwaooji | 84/616 |
| 5,388,496 | A | * | 2/1995 | Miller et al. | 84/454 |
| 5,390,579 | A | * | 2/1995 | Burgon | 84/454 |
| 5,396,827 | A | | 3/1995 | Miller et al. | |
| 5,427,011 | A | | 6/1995 | Steinberger | |
| 5,549,028 | A | * | 8/1996 | Steinberger | 84/454 |
| D378,683 | S | | 4/1997 | Ridinger | |
| 5,637,820 | A | * | 6/1997 | Wittman | 84/454 |
| 5,777,248 | A | * | 7/1998 | Campbell | 84/454 |
| 5,824,929 | A | * | 10/1998 | Freeland et al. | 84/454 |
| 5,854,437 | A | * | 12/1998 | Merrick et al. | 84/454 |
| 5,877,443 | A | * | 3/1999 | Arends et al. | 84/454 |
| 5,883,323 | A | | 3/1999 | Kaufman | |
| 5,886,270 | A | | 3/1999 | Wynn | |
| 5,936,179 | A | * | 8/1999 | Merrick et al. | 84/454 |
| 6,066,790 | A | | 5/2000 | Freeland et al. | |
| 6,184,452 | B1 | | 2/2001 | Long et al. | |
| 6,291,755 | B1 | | 9/2001 | Hine et al. | |
| 6,437,226 | B2 | | 8/2002 | Oudshoorn et al. | |
| 6,465,723 | B2 | | 10/2002 | Milano | |
| 6,653,543 | B2 | | 11/2003 | Kulas | |
| 6,791,022 | B2 | | 9/2004 | Green | |
| 6,894,212 | B2 | * | 5/2005 | Capano | 84/454 |
| 6,965,067 | B2 | * | 11/2005 | Kondo | 84/455 |
| 2005/0211064 | A1 | * | 9/2005 | Chiba | 84/454 |

OTHER PUBLICATIONS

WhitmanSpins Tuners, webpages, http://www.wittman-spins.com/tunerjackpopup.html, http://www.wittman-spins.com/tuneroperationpopup.html, http://www.wittman-spins.com/tunerpropopup.html.*
Wittman, web page http://www.wittman-spins.com/tunerjackpopup.html, printed on Dec. 15, 2005.

* cited by examiner

*Primary Examiner*—Lincoln Donovan
*Assistant Examiner*—Robert W. Horn

(57) ABSTRACT

A musical instrument tuner includes a means for measuring the frequency of a note played on an instrument, a minimal display means, a means for powering and depowering the tuner, and a means for collecting the signal to be measured. The tuner displays sharp and flat indications to the user, eliminating the ambiguous finite width "in-tune" window.

20 Claims, 14 Drawing Sheets

MUSICAL INSTRUMENT TUNER

PRIORITY

This application claims priority through U.S. Provisional Application No. 60/641,257 filed by Henry B. Wallace on Jan. 4, 2005 for "Musical Instrument Tuner."

BACKGROUND OF THE INVENTION

1. Field of the Invention

The present invention, a musical instrument tuner, relates to the measurement of the frequency (also called pitch) of a musical note played on a musical instrument, and optimum display of that information for use by the musician in tuning the instrument.

2. Description of the Prior Art

A musical instrument tuner (or hereafter referred to as simply a tuner), is intended to assist a musician in tuning a musical instrument. A tuner indicates in some way the deviation in frequency of a musical note from a predetermined frequency. Many such devices have been invented and many patented, and the patent space is replete with examples of various forms of this basic function. A survey of the prior art follows.

Tuners today have one characteristic in common, that being extensive informational displays. Typically tuners display the identity of the note being detected ('A' through 'G', with sharp and/or flat symbols), whether the note is fractionally sharp, flat, or in-tune, and other information related to the mode of operation of the tuner. Such modes may include manual vs. chromatic operation, selection of optimized tuning systems for fretted instruments, and display of non-tuning-specific information such as chord charts. Low battery indicators are common. Many tuners incorporate complex liquid crystal displays (LCDs) for user interface. Even tuners with so-called minimal displays have multiple light emitting diodes (LEDs) for display of the note being tuned and its sharp, flat, or in-tune status.

Kulas (U.S. Pat. No. 6,653,543, which issued on Nov. 25, 2003) teaches an elaborate display and control system with multiple modes of operation for various types of instruments. Nonstandard tunings (used by a minority of guitar players) are accommodated, as are non-tuner features such as chord chart and song list display. The invention encompasses analog to digital conversion of the instrument signal for external consumption, presumably by audio equipment. A metronome display is also included. Kulas starts out with a statement about versatile prior art tuners, stating, "While this versatility ensures that one model of tuner can be used for many different purposes, some users desire a more customized tuner with a display better suited for their particular needs." Kulas' thrust is that tuners are sometimes too feature-rich for use by one musician with one specific instrument, and this is true. However, Kulas goes on to describe a preferred embodiment with a pivoting color display screen (FIG. 1A, showing letters EADGBE) that is nearly as overcomplicated as the prior art, for tuning purposes. For example, it is totally unnecessary to display two 'E' characters since the two E notes on a guitar are two octaves apart. There is no danger of confusion, that is, of the guitar player tuning the low E string two octaves high or tuning the high E string two octaves low. This extra 'E' results in obviously wasted display space and higher cost. Similar wasted space is apparent for the "drop-D" tuning example given (FIG. 5A), where there would be two 'D' letters displayed (DADGBE).

Hine, et al. (U.S. Pat. No. 6,291,755, which issued on Sep. 18, 2001) teaches a tuner which is mounted in the interior of an acoustic guitar, visible to the player, with a digital display indicating which note is being tuned (alphabetically) and whether the note is sharp, flat, or in-tune.

Merrick, et al. (U.S. Pat. No. 5,936,179, which issued on Aug. 10, 1999) teaches a multi-element display consisting of lights for each note of the twelve note western musical scale, in addition to sharp, flat, and in-tune indicators.

Merrick, et al. (U.S. Pat. No. 5,854,437, which issued on Dec. 29, 1998) teaches a multi-element LED display with sharp and flat indicators (see Merrick, et al., FIG. 3). Thus, there is a finite window in the frequency domain corresponding to the in-tune indication of each LED for each string.

Wittman (U.S. Pat. No. 5,637,820, which issued on Jun. 10, 1997) also teaches a multiple LED display in a guitar tuner. One such tuner is advertised on a web site for sale. It requires considerable technical skill for installation and does require alteration to the instrument (changing a potentiometer), though the literature says otherwise.

Steinberger (U.S. Pat. No. 5,549,028, which issued on Aug. 27, 1996) teaches an alphabetic display in a guitar tuner, as does Adamson (U.S. Pat. No. 5,070,754, which issued on Dec. 10, 1991). Adamson's invention additionally displays the octave in which the note falls.

Each of the references cited, as well as many other tuner patents, describe an extensive display consisting generally of detected note displays and sharp, flat, and in-tune indicators. These displays are unnecessary, wasteful and costly, and are unneeded by many musicians.

A particular feature of extant musical instrument tuners is an in-tune indicator, which will be examined in detail herein. This is typically an LED or LCD which gives the user an indication that the pitch is one of: Fractionally sharp, flat, or in-tune. In addition to the patents cited above which teach this feature, numerous others exist. For example, Rosado (U.S. Pat. No. 4,018,124, which issued on Apr. 19, 1977) teaches a sharp, flat, and in-tune LED display system that operates on a per-string basis on a guitar. When a string is in tune, an LED is lit, and sharp or flat conditions cause the LED to be extinguished. Merrick, et al. (U.S. Pat. No. 5,936,179), cited previously, and Capano, et al. (U.S. Pat. No. 4,163,408, which issued on Aug. 7, 1979) teach three-state indicators.

Pogoda, et al. (U.S. Pat. No. 4,365,537, which issued on Dec. 28, 1982) states, "If the frequency of the vibrating string is too high, diode 64 is energized and if the frequency of the vibrating string is too low, diode 66 is energized. The tension on the string is then adjusted until it is brought into tune." This describes sharp and flat indicators, but also clearly implies a third in-tune region which is high but not "too high," and low but not "too low."

Milano (U.S. Pat. No. 6,465,723, which issued on Oct. 15, 2002) teaches a motor-driven tuning method, and it also uses a three-state in-tune criteria and display. Two of the display states are visually identical (flashing red light), but the display and frequency discrimination logic exhibits three distinct regions of measurement: Flat, sharp, and in-tune.

Long, et al. (U.S. Pat. No. 6,184,452, which issued on Feb. 6, 2001), regarding another automated tuning system, teaches a "closed loop tuning control means . . . arranged to receive said comparison signal and automatically control operation of said adjusting means (5) until said comparison signal indicates that the frequency of said electrical signal is substantially equal to said predetermined frequency," which is also a three-state discrimination of frequency. Wynn (U.S. Pat. No. 5,886,270, which issued on Mar. 23, 1999), another automated tuning system, discloses in the flowchart of FIG. 18 discrimination of "low," "high," and in-tune states.

Green (U.S. Pat. No. 6,791,022, which issued on Sep. 14, 2004) also recounts the prior art of three-state indicators by stating that tuners may "employ a frequency-measurement circuit that detects the primary frequency of the plucked string and indicates, usually on a visual display, whether the string is tuned high, low, or on key."

A vibratory indicator system is taught by Kaufman (U.S. Pat. No. 5,883,323, which issued on Mar. 16, 1999). This system, too, includes a three-state indicator: "Musical notes from the instrument, hereinafter referred to as "tuning notes", are "in tune" when within an acceptable tolerance range of acoustic pitch determined by the tuner." This language is used throughout Kaufman. A prototype described by Kaufman utilizes a commercially available tuner which includes a three-state tuning indicator with the vibrator controlled indirectly by the in-tune indicator's electrical signal.

Freeland, et al. (U.S. Pat. No. 6,066,790, which issued on May 23, 2000) teaches a multi-frequency tuner with a comprehensive display. Of particular interest is the statement: "The magnitude of the deviation can be generally indicated, for example by the number of lights illuminated. The display can be limited to indicating whether the measured frequency is sharp or flat with appropriate symbols or colored lights." The second sentence would seem to imply a two-state indicator, except it is made in the context of the previous sentence which is discussing the "magnitude of the deviation." This forces us to conclude that the second sentence suggests a modification of the means of displaying frequency deviation, with one or more lights or symbols on either side of the in-tune indicator.

Campbell (U.S. Pat. No. 5,777,248, which issued on Jul. 7, 1998) teaches a binary sharp/flat indicator in conjunction with a strobe tuning display. The text states that "The sharp/flat indicator provides for gross tuning to within range of the strobe display." The sharp/flat indicator is not intended to be used as a fine tuning device, and in fact Campbell states that fine tuning should be performed using the stroboscopic display. The display in its entirety is interpreted as a three part indicator: Coarse sharp, coarse flat, and degree of mistuning.

It is seen that this mode of operation of tuners, (sharp, flat, and in-tune or frequency deviation indicators) is the norm and is an assumed and unchallenged feature and function that designers of musical instrument tuners automatically incorporate into their designs and teach in the prior art without forethought and without any suspicion that a simpler mode of operation would be better. All the prior art references cited suffer this deficiency.

Another common tuner feature is a display indicator of the proportional deviation of the sensed note from a reference pitch, such as a mechanical or simulated meter movement (see Ridinger, U.S. Pat. No. D378,683, which issued on Apr. 1, 1997), or lights that flash at varying rates as a function of such deviation, or directional arrows on an LCD that are displayed as a function of such deviation, as in Kondo (U.S. Pat. No. 6,965,067, which issued on Nov. 15, 2005), Risch (U.S. Pat. No. 4,041,832, which issued on Aug. 16, 1977), and Steinberger (U.S. Pat. No. 5,427,011, which issued on Jun. 27, 1995). This display form is only useful to the vast majority of musicians to provide binary sharp/flat information; that is, telling them whether the instrument is sharp or flat. The cheap, uncalibrated nature of these tuner displays renders the scale markings practically useless, where present. The inventor has in the course of his work tested numerous commercial tuners and has found this to be the case. Displays consisting of blinking lights or arrows are of little value because the user cannot relate the blinking rate to a certain pitch deviation. For example, Wittman (U.S. Pat. No. 5,637,820, which issued on Jun. 10, 1997) discloses a blinking LED: "Thus, if the pitch is 20 cents sharp, the right LED would blink eight times per second." There is likely no user who could take this information and accurately judge a pitch error. Elimination of these features saves cost and display space, and the user does not miss them.

Objects and Advantages of the Improved Musical Instrument Tuner

Several objects and advantages of the improved musical instrument tuner are:

1. The display of the tuner is very minimal, providing only the necessary information to tune the instrument (whether the note is sharp or flat), saving space, cost, power consumption, and minimizing visual impact upon the instrument.
2. The tuning algorithm eliminates the ambiguous in-tune window in the frequency domain, allowing more accurate tuning and minimizing user confusion. Also eliminated is the proportional display indicating degree of mistuning.
3. The tuner may be located external or internal to the instrument. If internal, it cannot be forgotten or lost as long as the musician has possession of the instrument.
4. The tuner is so small that it can be mounted in a multitude of places on the instrument, either as an aftermarket upgrade or during manufacture.
5. The tuner operates on a tiny lithium coin cell battery, eliminating the need to find space in an instrument to hide a nine volt battery.
6. No permanent modifications need be made to the instrument, allowing the tuner to be installed and de-installed (if needed) on valuable vintage instruments.
7. The small tuner adds negligible weight to the instrument.
8. The tuner is protected from damage inside the body of the instrument, if so mounted. (Many prior art tuners are made of cheap plastic and are damaged easily, and this is a common annoyance to musicians.)
9. The tuner operates on very low power, allowing long battery life, typically years.
10. The tuner needs no mechanical switches to turn it on or off, but uses a touch sensitive system. This lowers cost and complexity and allows any electrically floating metal surface on the instrument to be used as the on/off touch sensitive control.
11. For an internally mounted tuner, no cables are required to tune the instrument. It may be tuned while disconnected from an amplifier.
12. The tuner circuitry operates at low clock frequencies to avoid electromagnetic radiation and regulatory testing costs.
13. The improved musical instrument tuner encourages proper stringed instrument tuning, that is, from a flat condition and moving up in pitch.

SUMMARY OF THE INVENTION

The improved musical instrument tuner eliminates of the ambiguous in-tune window, allowing the user to tune an instrument more accurately than prior art tuners with in-tune indicators. That innovation results in a smaller display format, enabling a lower cost, lower power, lower weight, and smaller design for manufacture. A touch sensitive on/off function removes the need for a mechanical switch and opens up options for an easier, less visually obtrusive installation in musical instruments.

DETAILED DESCRIPTION

Typical musical instrument tuners operate by detecting the frequency of the note that is played and displaying the alphabetic name of the note (or nearest note, within plus or minus 50 cents, a cent being 1/100 of a semitone), a sharp or flat symbol (for example, the "#" for the note C#), and an as-measured sharp or flat indication (possibly proportional to pitch deviation from in-tune). This is done to show the user in which direction to tune the note, and an in-tune indication when the note is close to the in-tune frequency.

The improved musical instrument tuner demonstrates that a) the extensive displays on existing tuners are generally more than the typical musician needs to tune an instrument, and b) the in-tune indicator introduces errors and can be eliminated, resulting in improved tuning performance. The improved musical instrument tuner satisfies musicians with a more accurate tuner which is actually more compact, has fewer parts and is easier to use. Marketing of the improved musical instrument tuner after the filing of U.S. Provisional Application No. 60/641,257 has resulted in comments from professional musicians that support this claim, after they have purchased and used an embodiment of the tuner.

Further, the improved musical instrument tuner is so small and power efficient that it may be mounted in numerous locations on an instrument where tuners have not before been mounted, providing implementation options never before considered but now possible through its minimally sized display.

Further, since many musical instruments are made of metal or contain metal parts accessible to the user, the tuner may be actuated without standard mechanical switches, but rather by sensing the resistance of the user's body as the hands touch exposed metal parts on the instrument. This is called a touch sensitive switch, and it avoids the need to mount expensive switches on the instrument, some of which may be visually obtrusive, or the addition of which could devalue a vintage instrument. The exposed metal parts may be preexisting on the instrument or may be added if needed, preferably in unobtrusive locations which do not detract from the looks or function of the instrument. In this specification, reference to a "touch switch" or to the user's "touch" in this context refers to the user completing a circuit path with physical touch as described.

The Ambiguous In-Tune Window

Figure 1:
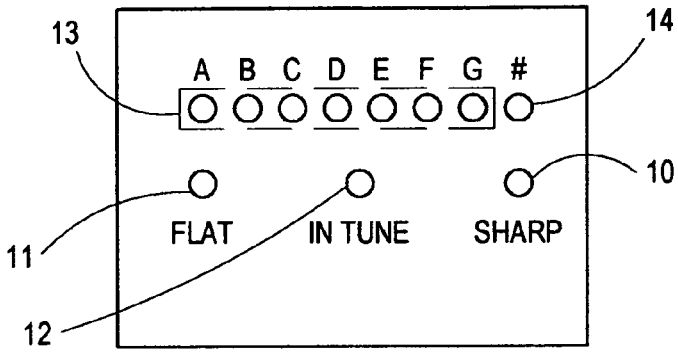
FIG. 1 (PRIOR ART)
FIG. 1 is a sketch of the front panel layout of a typical tuner showing the display of notes and the sharp, flat, and in-tune indicators (all using LEDs, for example).

The typical tuner display is shown in FIG. 1. This display is composed of a number of LEDs 13 which indicate the note being detected by the tuner, and LED 14 indicating whether the note is one of the sharp notes of the twelve note western musical scale. There is also a FLAT tuning indicator LED 11, a SHARP tuning indicator LED 10, and an IN TUNE indicator LED 12. This typical tuner display is drawn for the purposes of discussion only. Extant tuners may contain these functions as implemented in other display formats using LCDs or even electromechanical devices. However, these indicators embody the basic information conveyed by many if not most modern tuners and the figure serves our discussion of how the improved musical instrument tuner differs from and improves on these tuner functions.

Figure 2:
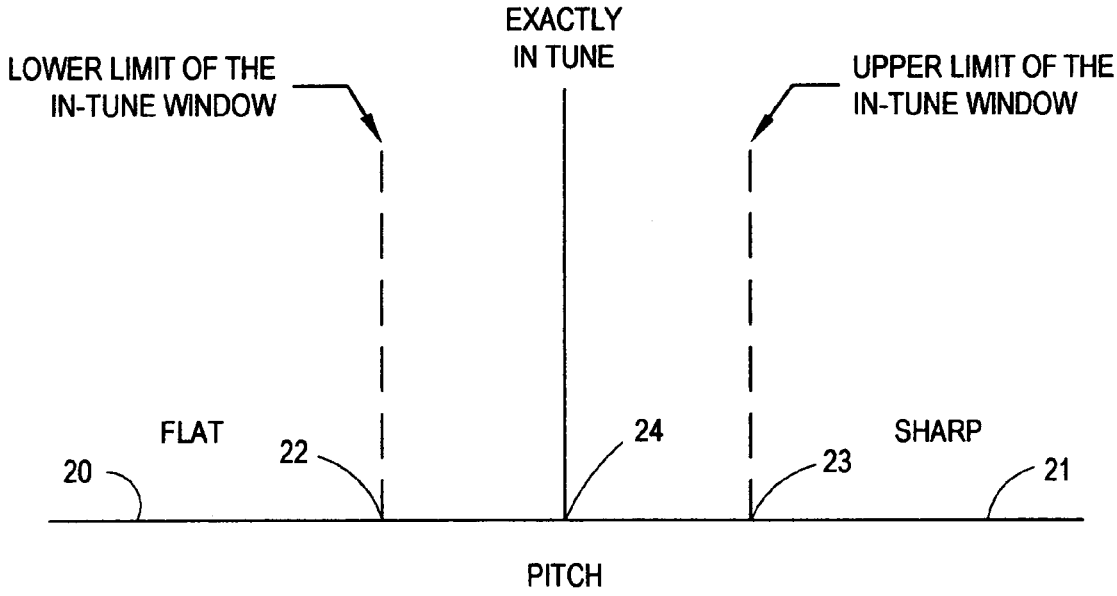
FIG. 2 (PRIOR ART)
FIG. 2 is a frequency domain graphical representation of the detection characteristic of a typical tuner, showing the flat, sharp and in-tune regions defined by the tuner's frequency detection and display algorithms.

The typical tuner can be characterized by its frequency domain response to musical notes. In fact, that is a tuner's purpose, to discriminate between notes in the frequency domain. FIG. 2 shows this graphically. The horizontal axis of the graph is the pitch or frequency axis, with increasing frequency proceeding to the right in the diagram. The tuner's algorithms define three regions, flat, sharp, and in-tune. That is, if the pitch of the note is in the region 20 labeled FLAT, the tuner indicates such. The example tuner in FIG. 1 lights the FLAT LED 11 for example. If the pitch of the note is in the region 21 labeled SHARP, the tuner indicates such. The example tuner in FIG. 1 lights the SHARP LED 10 for example. If the played note falls within the bounds of the lower limit of the in-tune window 22 and the upper limit of the in-tune window 23, the tuner indicates that the note is in tune. The example tuner in FIG. 1 lights the IN TUNE LED 12 for example.

Customarily, a musical note is considered to have the same designation (for example, 'D') and to be the same note if it is within plus or minus 50 cents of true pitch. The example tuner in FIG. 1 is assumed to behave this way, as commercial tuners do.

Several problems are apparent from the diagram and from practice as such a tuner is used to tune an instrument. First, how wide should the in-tune window be? It is obvious that the narrower the window the closer to pitch note may be tuned. However, in practice, the pitch of a note varies as it is being played, perhaps because of variations in a horn player's breath, or a guitar player's finger pressure on a string. The narrower the window is made, the more indeterminate the in-tune indication becomes, until it is so jittery as to be useless. Practically speaking, the lower limit on the width of the in-tune window is three to five cents for a guitar tuner, wider for other instruments.

Tuners on the market exhibit irregularities in the position of the in-tune window. The window typically varies in width depending on which direction the string is tuned from, starting from within or without the window. For example, starting at the note A (exactly on pitch) and tuning sharp, then starting at the note A (exactly on pitch) and tuning flat, the window may be found to be five cents wide. However, starting flat from A and tuning up, then starting sharp from A and tuning down, the window is likely to be narrower, perhaps only three or four cents wide. In addition, the window may not be symmetric and centered on the proper pitch, or it may have hysteresis at the sharp or flat end, but not both. All these effects conspire to make typical tuners difficult to use for musicians, and even when the tuner says "in-tune," the note may be five cents or more displaced from another instrument tuned by the same user with the same tuner.

One prior art invention disclosed by Miller, et al. (U.S. Pat. No. 5,396,827, which issued on Mar. 14, 1995) goes so far as to make the in-tune window variable in width to mitigate some of the negative effects on players of various types of musical instruments. This "innovation" is entirely unnecessary for tuning an instrument, as will be shown now.

Eliminating the In-Tune Window

Figure 3A:
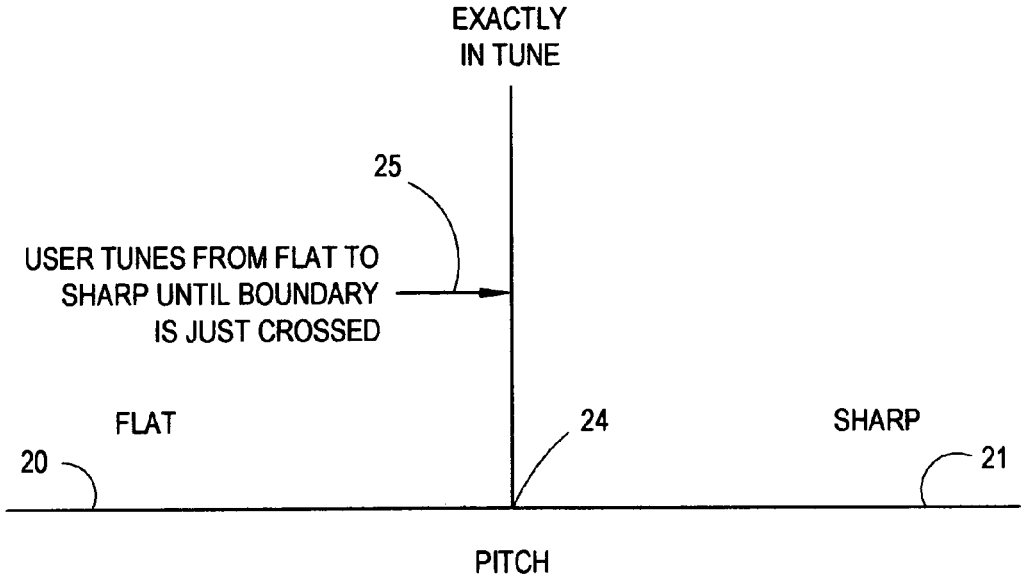
FIG. 3A is a frequency domain graphical representation of the ideal detection characteristic of a tuner, showing the flat and sharp regions defined by the tuner's frequency detection and display algorithms.

Ideally, the width of the in-tune window should be zero cents, and that is one of the objects of the improved musical instrument tuner. FIG. 3A illustrates this. Instead of there being three tuning states with the display active (as in FIG. 2), there are only two states with the display active, SHARP 21 and FLAT 20. As the user slowly tunes the instrument (for example, from flat to sharp as indicated by the arrow 25), the display of the tuner switches from a FLAT indication to a SHARP indication at just the point the note crosses the point of proper tuning 24. At just that instant, the user recognizes such indication from the tuner and stops the instrument tuning process. The net result is that the pitch of the note is closer to the point 24 being EXACTLY IN TUNE than if the user employed a standard tuner which behaves as in FIG. 2.

Note that the display has two active (for example, illuminated) states during the tuning process, SHARP 21 and FLAT 20, and those states are selected based solely on the algebraic sign of the deviation of the musical note from the EXACTLY IN TUNE point 24, or a modification of that as will be explained presently. If the deviation is in the flat direction, the sign of the deviation is negative, else the sign is positive. When the display is off, it is considered inactive.

Overshoot Compensation

In practice, the user may overshoot the EXACTLY IN TUNE point 24 by some fraction of a cent, and this is acceptable and an inaudible pitch deviation. It is important to note that there is no need whatsoever for the user to adjust the pitch of the note in the flat direction once the EXACTLY IN TUNE point 24 has been crossed moving in the sharp direction, as long as the user tunes with moderate care. There is no operation of "feeling the peak" as described in Oudshoorn, et al. (U.S. Pat. No. 6,437,226, which issued on Aug. 20, 2002) in that description of an automatic tuning process.

However, since the user can overshoot the EXACTLY IN TUNE point 24 by some cent or fraction of a cent, and the magnitude of overshoot is dependent mainly upon the type of instrument being tuned, and is a systematic error, it may be compensated to a great extent by moving the EXACTLY IN TUNE point 24 some fraction of a cent in the other direction, for example to the left on the diagram in FIG. 3A. This innovation results in there being practically zero error in the tuned note. This is defined as the addition of a positive or negative frequency offset as needed, called overshoot compensation herein.

Figure 3B:
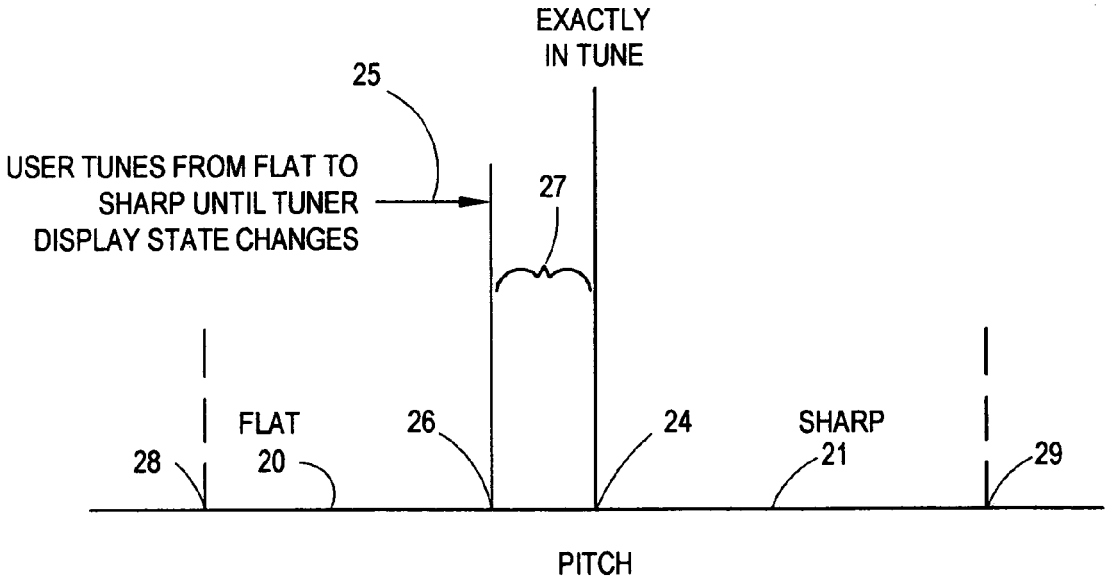
FIG. 3B is a frequency domain graphical representation of the detection characteristic of the improved musical instrument tuner, showing the flat and sharp regions defined by the tuner's frequency detection and display algorithms, with overshoot compensation.

This innovation is illustrated in FIG. 3B, where the tuner display does not change state at EXACTLY IN TUNE point 24, but rather at predetermined central frequency 26. A distance 27 between these two points corresponds to the typical overshoot during tuning and effectively compensates for it, with the resulting pitch of the instrument being typically within a cent of EXACTLY IN TUNE point 24.

Further, since the tuner may only recognize a certain subset of the twelve notes in the western musical scale, when the sensed frequency is below a predetermined lower frequency 28 and above a predetermined upper frequency 29, the display is turned off (termed inactive), indicating to the user that no note is being detected. These limits are typically set 50 cents above and below the EXACTLY IN TUNE point 24. A tabular storage method is used to organize the set of frequencies and notes, and through this table it is possible to select which notes result in indications and which do not, for example by setting the predetermined frequencies to zero for a particular musical note, forcing that note's frequency to appear greater than the predetermined upper frequency 29 in all octaves.

(In all references herein, the predetermined lower, central, and upper frequencies increase in value in that order.)

Miller, et al. (U.S. Pat. No. 5,388,496, which issued on Feb. 14, 1995) discloses a two-state colored tuning indicator (seemingly as an afterthought), but lists none of its benefits, and further does not disclose overshoot compensation.

Overshoot compensation is effected by offsetting the predetermined musical note frequency within the tuner as a proportion of the target frequency or frequencies (for example, expressed in cents) and requires no additional processing on the part of the tuner. Such compensation can be performed on a per note basis, adjusting for differences in how each type of instrument is tuned and the likely overshoot possible during tuning of each musical register or note. For example, several gauges of strings are customarily used on one guitar, so the overshoot compensation (frequency offset) may be matched to each string as needed. Such frequency offsets may be tabulated in the microcontroller and need not be computed at run time.

The typical value of this overshoot compensation for a guitar application is less than one cent, which is half or less the in-tune window width of marketed guitar tuners.

A further innovation is termed dynamic overshoot compensation and is a two-sided compensation that adapts to the tuning direction (sharp-to-flat or flat-to-sharp) that the user is undertaking. To accomplish this, the tuner selects predetermined central frequency 26 (see FIG. 3B) to be a predetermined amount greater than EXACTLY IN TUNE point 24 if the musical note is sharp with reference to point 24. As the user tunes the note flatter, the predetermined central frequency is then on the proper side of the EXACTLY IN TUNE point to provide overshoot compensation.

Conversely, the tuner selects predetermined central frequency 26 to be a predetermined amount less than EXACTLY IN TUNE point 24 if the musical note is flat with reference to point 24. As the user tunes the note sharper, the predetermined central frequency is on the proper side of the EXACTLY IN TUNE point to provide overshoot compensation.

The result of dynamic overshoot compensation is an accurate tuning experience regardless whether the note is tuned from the sharp or flat direction.

Reducing Display Complexity

Most musicians play music with other musicians according to standards and customs which are uniform. For example, most musicians play in what is called concert pitch which defines the note A as being 440.0 Hertz (in one of its possible octaves). Guitar players usually tune their instruments so that the strings are tuned thus, from lowest to highest pitch: E, A, D, G, B, E. Some instruments, such as horns, have only a limited tuning range. A piano is so difficult to tune that no musician would consider retuning it briefly to a nonstandard pitch.

Taking advantage of this custom of musicians to typically play in standard tunings and at concert pitch, a tuner's display may be optimized considerably. For example, a six string guitar's open strings exhibit only five unique notes (not counting one of the octave-related E notes). In this case, a guitar tuner need only recognize the notes E, A, D, G, and B, and octaves of the note E. Since the guitar player knows which string is being plucked, the tuner need not display this information. In fact, it takes only seconds for a guitarist to roughly tune all six strings to near the correct pitch by audibly comparing the tones produced by adjacent strings. The guitar tuner need only display SHARP and FLAT indications for the five aforementioned notes, and not even their values, octaves or how far off pitch they are. This simple indicator is all the guitarist needs to tune the instrument to standard tuning and concert pitch. The improved musical instrument tuner may be customized for other instruments, providing a palette of notes characteristic to a particular instrument in order to maintain the minimal display format and satisfy the user's needs.

Figure 4:
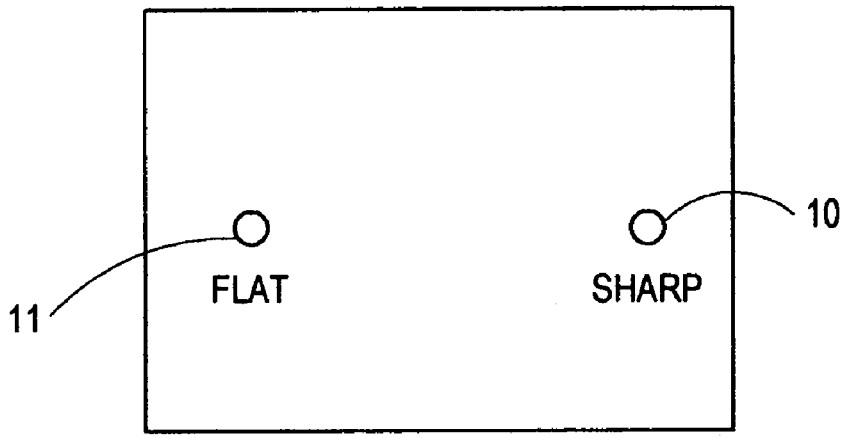
FIG. 4 is a sketch of the front panel layout of a tuner with a minimized display showing the SHARP and FLAT indicators.
Figure 5:
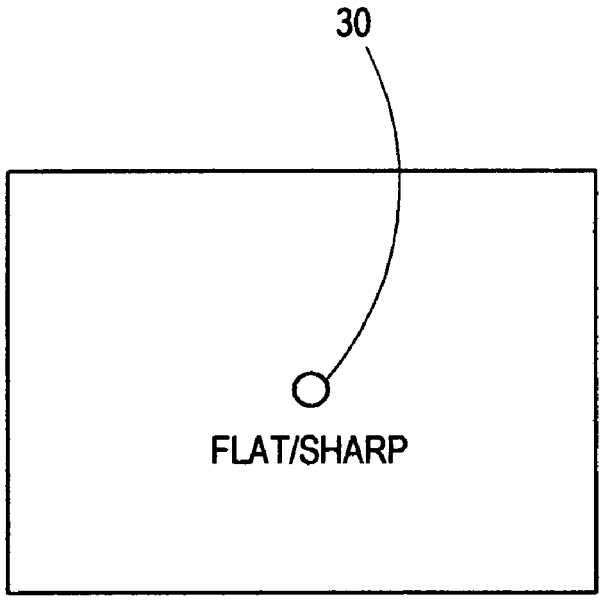
FIG. 5 is a sketch of the front panel layout of a tuner with a further minimized display showing a singular SHARP and FLAT indicator.

See FIG. 4. This is a minimization of the tuner user interface presented in FIG. 1 with only SHARP 10 and FLAT 11 indicators. These are shown as separate LEDs for illustrative purposes, but could be other types of indicators (LCD, for example). The improved musical instrument tuner takes this innovation a step further and condenses the entire tuner display function into one indicator 30 (electromechanical or visual), as in FIG. 5. This indicator can be instantiated as a two-color LED, dual-shape symbols on an LCD, a single color LED or light which is brightness modulated or flashing, or a tactile or mechanical actuator which is observable by or in contact with the user. No matter the indication means, the user employs the indicator to know when the note being tuned has just crossed the predetermined central frequency 26 in the graph of FIG. 3B, taking into account overshoot compensation.

The user already knows which note is being tuned (approximately) and needs only the indication as described above to tune the instrument to exact pitch.

However, there are cases in which a user is tuning an instrument which is grossly out of tune. For example, a guitarist who has just installed a new set of guitar strings has no pitch reference which to use. The improved musical instrument tuner provides such an absolute point of reference by identifying one particular note it hears (within predefined limits), for example the note E, called the predetermined reference frequency. This absolute point of reference is marked with a special indication, such as a characteristic flashing of the FLAT/SHARP indicator 30, but for only a short period of time of predetermined duration amounting to a few hundred milliseconds. This period is limited so as not to confuse the user or foul the measurement with interference caused by a continuously pulsing indicator. Thus the guitarist would tune up the low E string on the guitar until the tuner produces this indication, then rough tune the rest of the strings by comparing them audibly to the low E, then use the improved musical instrument tuner to tune the strings to exact pitch. After that, the strings are close enough to pitch that only the single LED display is needed to maintain the guitar in excellent tune.

DESCRIPTION OF THE PREFERRED EMBODIMENT

The preferred embodiment of the invention consists of a mounting structure for the tuner in or on the instrument to the advantage that the tuner cannot be misplaced or damaged apart from the instrument. Such an installation may be effected with little visual degradation of the instrument owing to the minimal display format. Further, the touch sensitive activation method eliminates the need for a separate switch, and the attending visual and physical impact.

Figure 6:
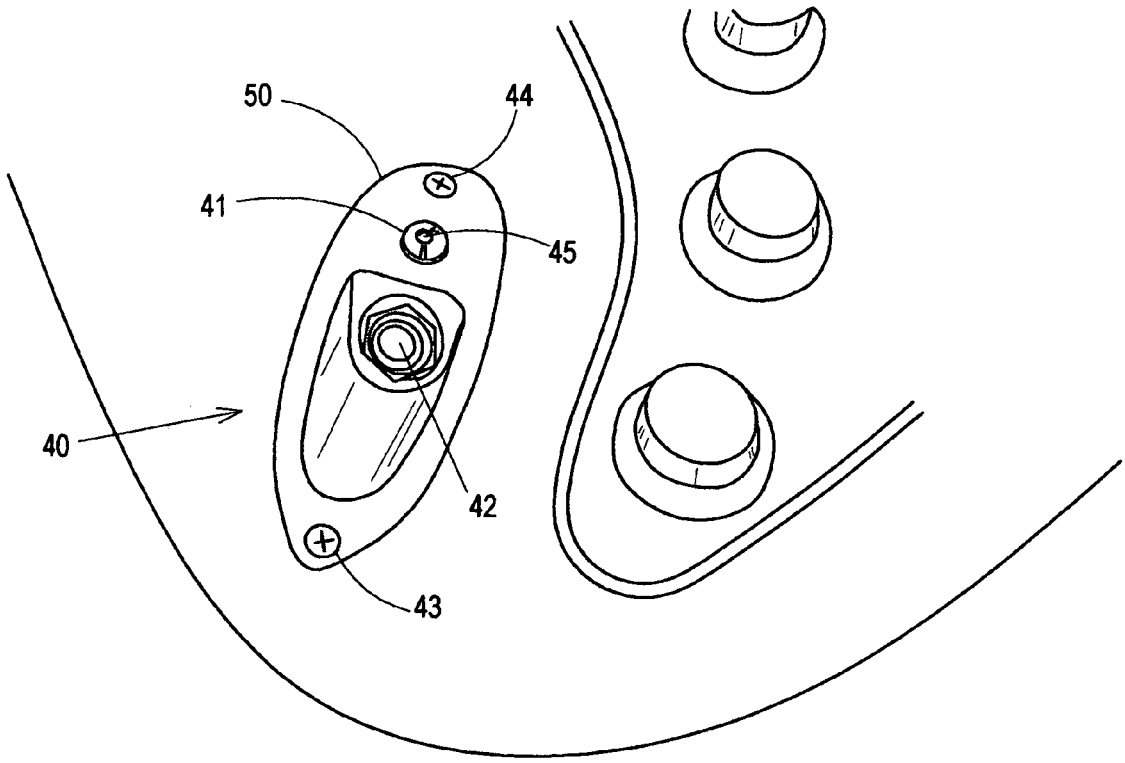
FIG. 6 shows the preferred embodiment installed in a guitar.
Figure 7A:
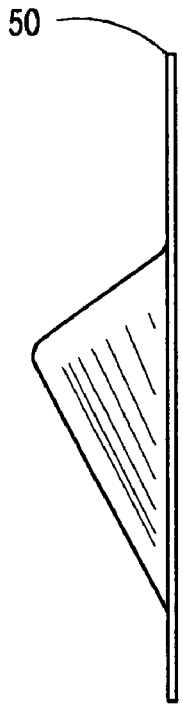
FIGS. 7A and 7B show the bare jack plate used in the preferred embodiment depicted in FIG. 6.
Figure 7B:
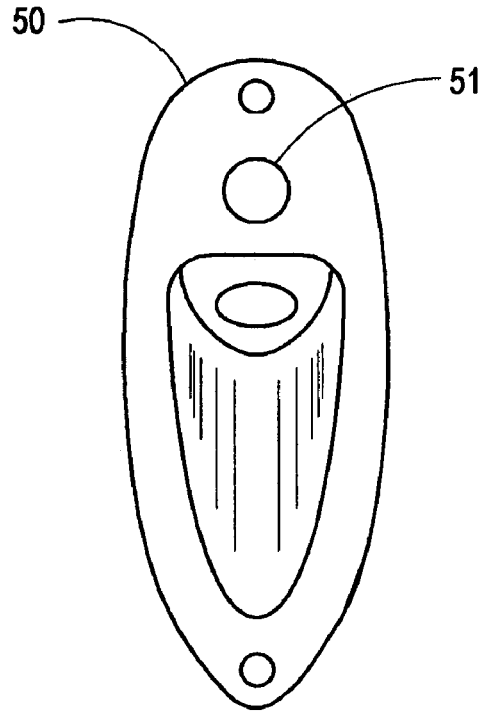

Such an embodiment is illustrated in FIG. 6. This installation of a tuner assembly 40 is shown in a popular guitar, which model comprises a significant fraction of the market for electric guitars. The tuner is attached to a substrate or chassis, the jack plate 50 that is a customary and conventional component on this type of guitar, but is applicable to other instruments as well, either in a similar jack plate or installed on other hardware or in the body or neck, without loss of generality. The bare jack plate 50 is illustrated in FIG. 7A and FIG. 7B in side and rear views, respectively, to complement the front view in FIG. 6. The term jack plate refers to a plate of material used to mount the audio jack onto the instrument, the audio jack carrying the instrument's signal to external amplification.

Such jack plates 50 are available in the marketplace as a standard stamped metal item, but without the hole 51 (see FIG. 7B), custom drilled for the installation of the present tuner's indicator light housing 41 (a conventional component), shown in FIG. 6. The tuner assembly 40 contains a ¼ inch phone jack 42. The tuner assembly 40 is attached to the guitar using two wood screws 43 and 44.

The visual impact of the tuner assembly 40 consists entirely of indicator light housing 41 (7.9 mm in diameter), and its LED 45 (an illuminatable element). This is insignificant compared to the total area of the face of the guitar and is very unobtrusive. The LED 45 protrudes above the body of the indicator light housing 41 and is easy for the guitarist to see in use. Prior art by Wittman shows a tuner which appears to fit a standard routed cavity, but the appearance of the tuner is totally dissimilar to the standard jack plate, detracting from the appearance of the guitar.

Figure 8A:
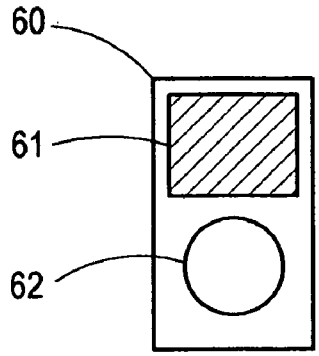
FIG. 8A shows the circuit board used in the preferred embodiment.

In FIG. 8A, circuit board 60 holds electronic processing circuits that determine the frequency of the played note and drive the display. The display may be contained on the circuit board, though in the described embodiment it is external. Also shown are a coin cell battery holder 61 and a hole 62 for acceptance of the threaded barrel of the phone jack 42.

Figure 8B:
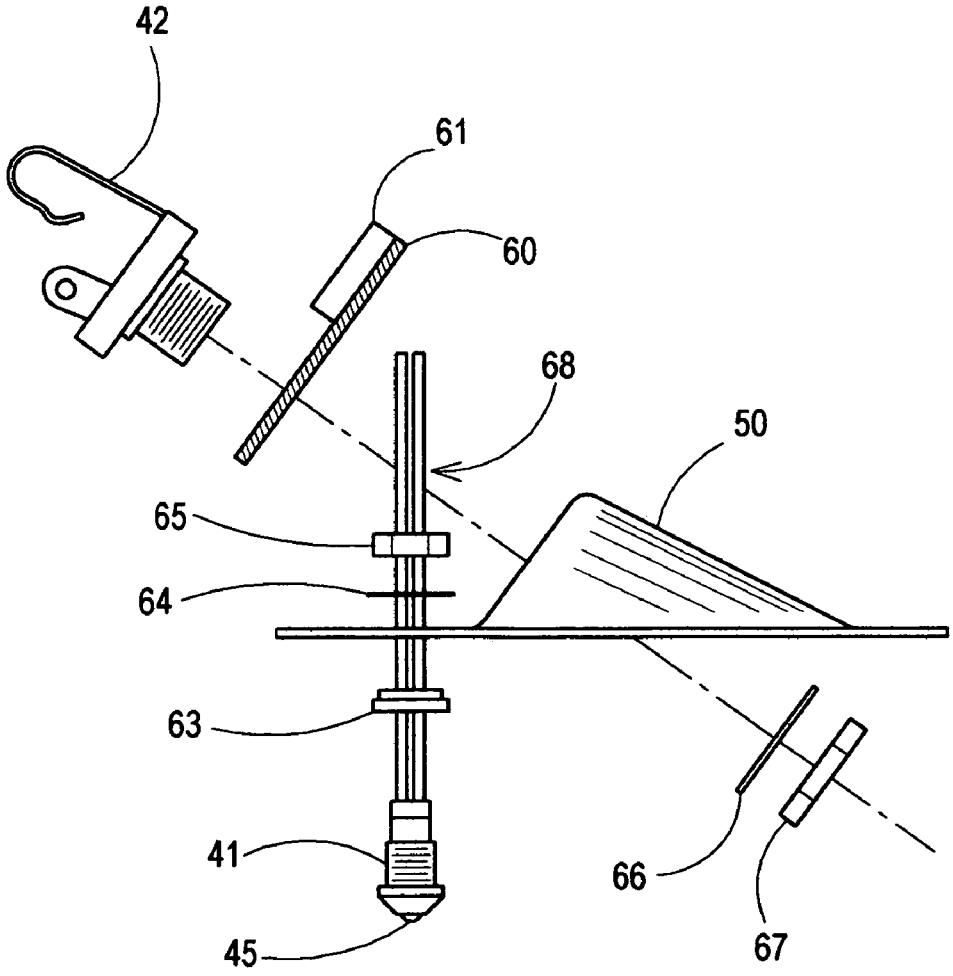
FIG. 8B is an exploded view of the preferred embodiment.

An exploded view of the assembly is shown in FIG. 8B. Circuit board 60 is attached to the jack plate 50 by the attachment of the jack 42 using a hex nut 67 and flat washer 66. Display indicator housing 41 is metal and holds a dual color LED 45 with the LED's two wires 68 protruding from the rear of the indicator body. The indicator housing 41 is attached to the jack plate 50 using a hex nut 65, insulating flat washer 64 and insulating shoulder washer 63. These insulating washers prevent the metal of the indicator housing 41 from electrically touching jack plate 50. The color of the washer 63 is chosen to complement the color scheme of the guitar.

Figure 9A:
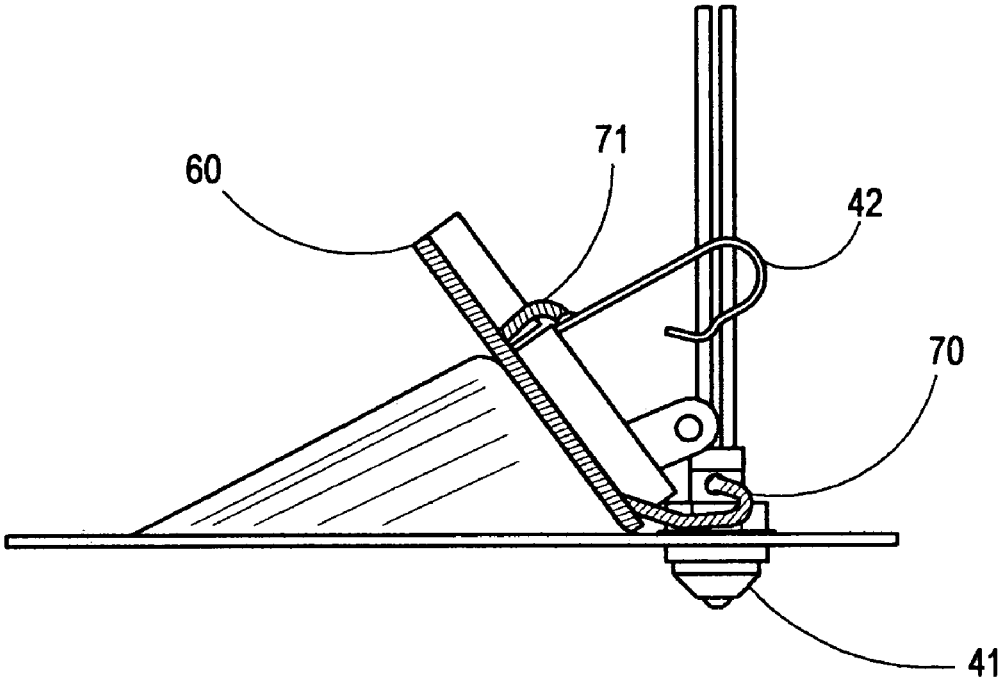
FIG. 9A shows a view of the wiring of the circuit board in the preferred embodiment.

FIG. 9A shows the connection of a wire 70 from the body of LED indicator housing 41 to the circuit board 60. This is done so that the circuitry can detect conductivity from the indicator housing's bare metal to the body of the jack plate 50, which is connected to the ground reference for the musical instrument. This figure also shows the wiring 71 of the circuit board 60 to the audio jack 42 so that the circuit can sample the signal coming from the instrument for tuning.

Figure 9B:
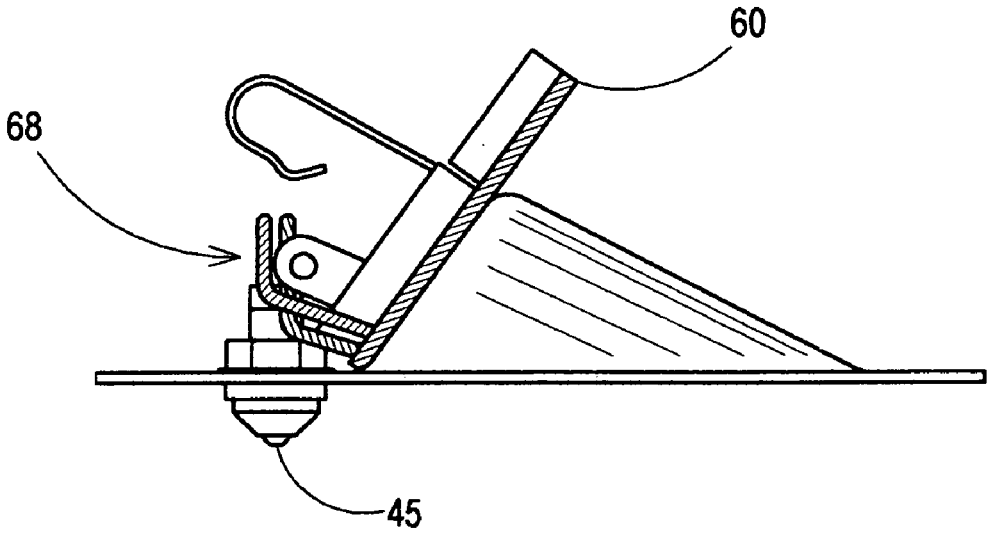
FIG. 9B shows the opposite side view (with reference to FIG. 9A) of the wiring of the circuit board in the preferred embodiment.

FIG. 9B shows connection of the wiring 68 of the indicator LED 45 to the circuit board so that the light may be lit to indicate various states of tuning consistent with the descriptions herein.

The tuner assembly 40 may be retrofitted to an existing guitar or installed in a new instrument. The assembly fits the customary routed cavity in the body of this type of guitar. Further, the typical ground and signal connections to the factory installed non-tuner jack and jack plate are identical to the connections required to the improved musical instrument tuner, so that guitar technicians and moderately skilled users may easily install this tuner assembly, as if they were replacing a defective jack.

Block Diagram of the Preferred Embodiment

Figure 11:
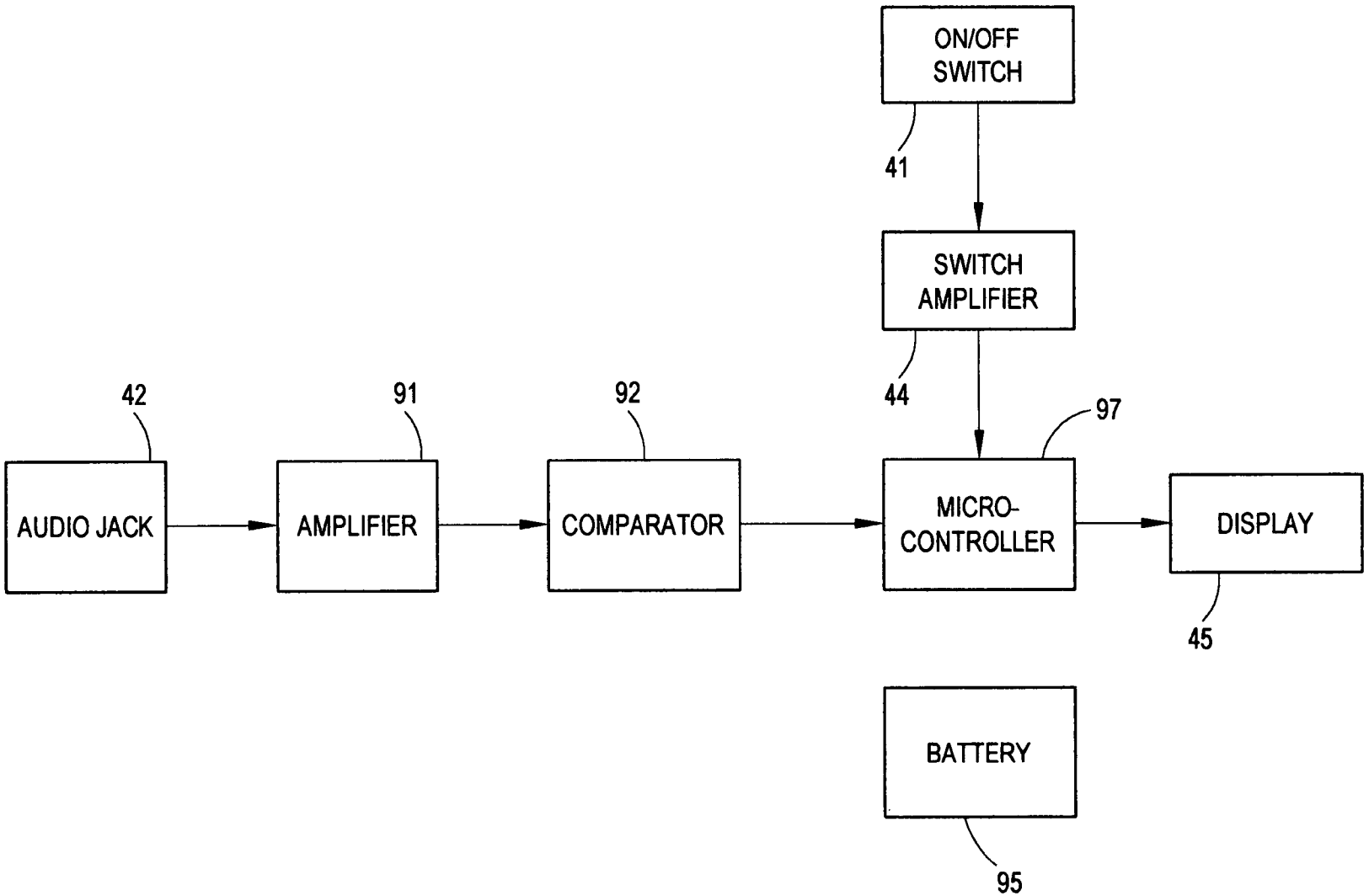
FIG. 11 shows a block diagram of the electronic hardware of the preferred embodiment.
Figure 12:
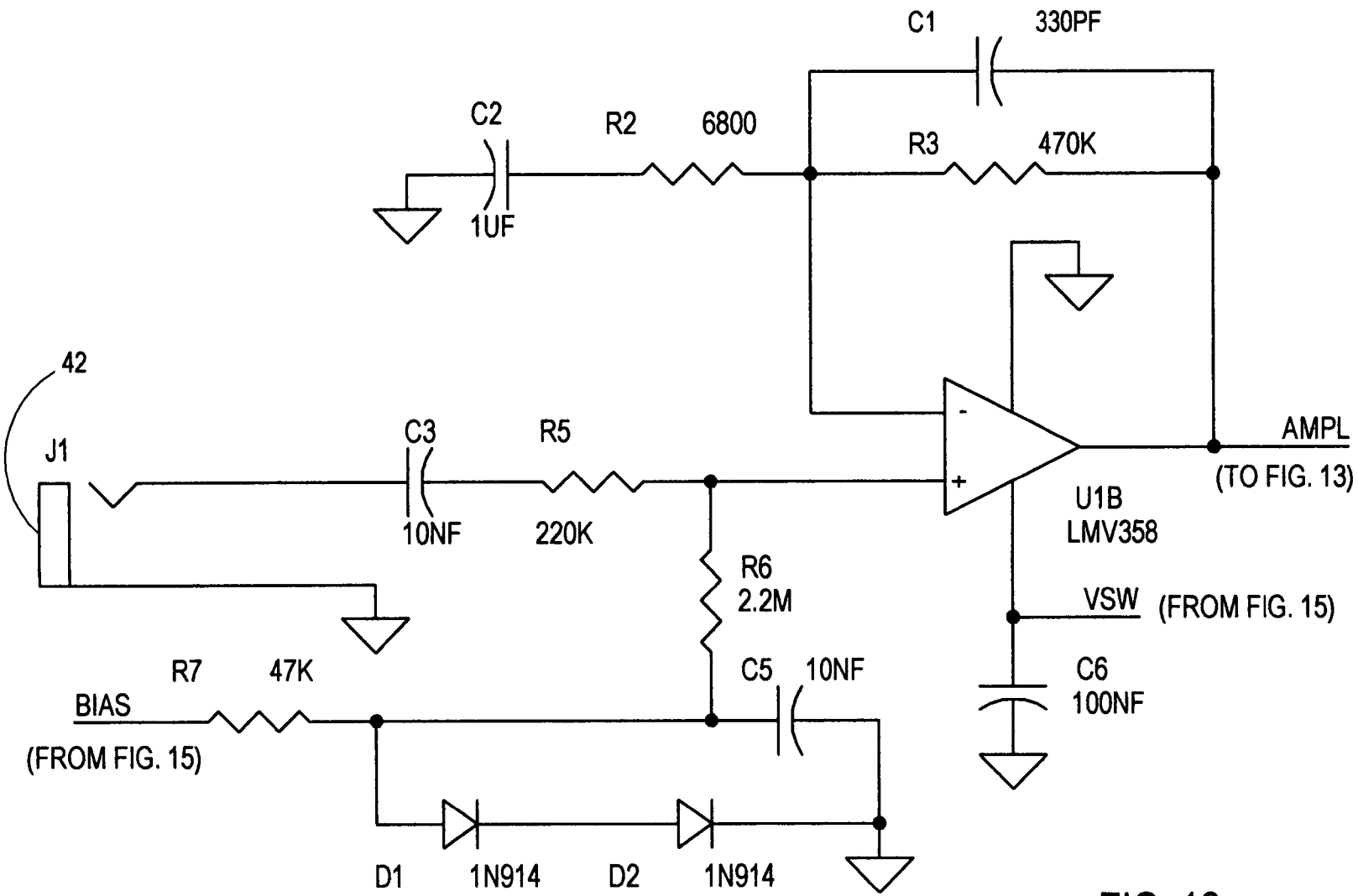
FIG. 12 shows a schematic diagram of the input audio amplifier circuit of the preferred embodiment.

The block diagram of FIG. 11 shows the circuitry of the preferred embodiment of the improved musical instrument tuner. Audio jack 42 connects to an amplifier 91 which amplifies the signal from the jack by approximately 37 dB. The output of the amplifier 91 will likely clip for strong input signals due to the high gain. That signal is then fed to a voltage comparator 92 which thresholds the signal for application to a microcontroller 97.

Touch sensitive on/off switch 41 (the LED housing) is connected through a switch amplifier 44 to the microcontroller 97 to command it to turn on and off, controlling the power state of the tuner. The off state of the microcontroller is actually a low power condition that draws very little power supply current (microamps), rather than a total disconnection of the battery. The microcontroller 97 drives a display, in this case the aforementioned LED 45. A battery 95 supplies power to the microcontroller 97, which then powers the on/off switch amplifier 44, the amplifier 91 and comparator 92 (connections not shown). This is done to allow the microcontroller 97 total control over the power consumption of the improved musical instrument tuner.

Schematic of the Preferred Embodiment

The schematic of the preferred embodiment appears in FIGS. 12, 13, 14 and 15. In the following description, the signal VCC is the battery voltage and is common to all schematic diagrams. Also, references to logic levels "low" and "high" refer to voltages near ground and VCC, respectively, as is customary when dealing with digital logic.

The instrument's signal is applied to the tuner at the audio jack 42 and is amplified by conventional amplifier U1B (see FIG. 12), a commodity operational amplifier. Capacitor C3 is a DC blocking capacitor, and resistor R5 acts to increase the input impedance of the circuit to prevent loading or distorting the signal being sampled from the instrument. The microcontroller 97 (component U2 in FIG. 15) supplies a digital signal called BIAS to amplifier U1B through resistors R7 and R6. Resistor R7 and silicon diodes D1 and D2 act to form a voltage source of approximately 1.2V for biasing amplifier U1B through its noninverting input. Capacitor C5 suppresses any electrical noise on this signal.

The gain of the amplifier circuit is set by resistors R3 and R2 in the standard noninverting configuration and is approximately 37 dB. Capacitor C1 reduces the frequency response at frequencies above 1026 Hz, and this capacitor value may be selected according to the frequency range of the instrument being tuned, in the general case. Capacitor C2 is a DC blocking capacitor. The gain of this amplifier is so high that strong signals will cause it to clip, but that is acceptable because the microcontroller needs a digital signal to work with anyway.

Amplifier U1B is powered by the microcontroller 97 using the signal VSW, filtered by capacitor C6. Thus, the microcontroller can depower the amplifier when it is not in use, saving battery life. Also to conserve battery life, signal BIAS is maintained at ground potential until VSW has fully powered the amplifier. BIAS is then taken high to bring the amplifier U1B into its linear region. When the amplifier is off (VSW=0V), BIAS is set to 0V to terminate the current drain through R7, D1, and D2. The tuner circuitry is constructed using well known power saving techniques to extend battery life.

Figure 13:
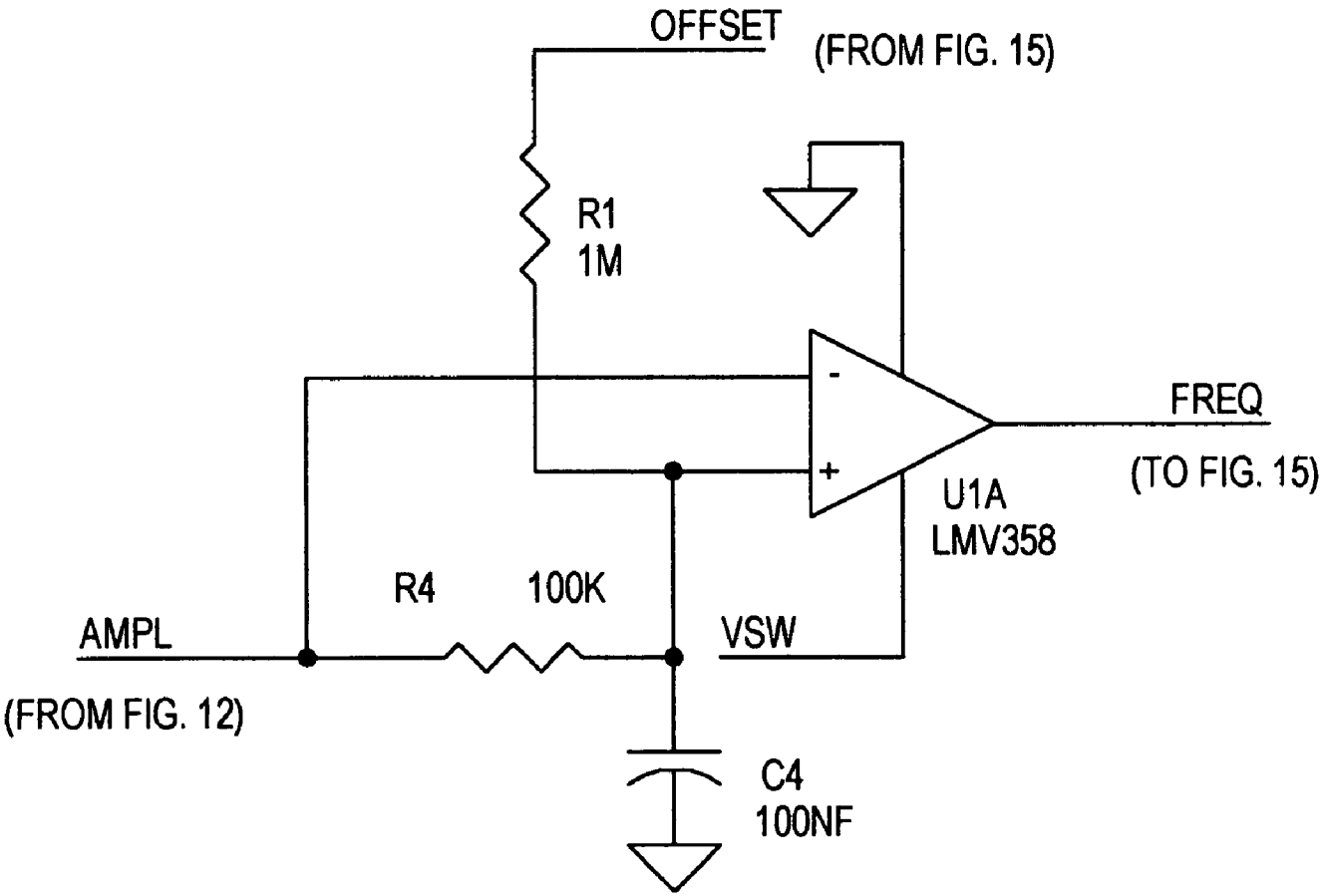
FIG. 13 shows a schematic diagram of the audio comparator circuit of the preferred embodiment.

The output of amplifier U1B is the signal AMPL and drives comparator U1A (see FIG. 13). This comparator is configured with a circuit which sets the comparator threshold at the average DC level of the AMPL signal. This circuit consists of components R4 and C4 and enhances the tuner's ability to process low level signals by making it more tolerant of varying comparator offset voltages and shifting signal levels. The output of comparator U1A drives the microcontroller 97 on signal FREQ so it can measure the frequency of the instrument's signal.

Further, the microcontroller 97 has control of the comparator's threshold through the OFFSET signal and resistor R1. Since the opamp pair (U1B and U1A) is running at such high gain, noise on the guitar signal cable is amplified and may be misinterpreted by the microcontroller as a valid signal, causing erratic operation. To avoid this, the control OFFSET is used to offset the threshold of comparator U1A. Before a signal is detected, OFFSET is set to 0V, forcing FREQ to 0V by the application of a small DC offset to the noninverting input of the comparator, until a strong signal arrives. When a changing logic level is detected by the microcontroller 97 on the FREQ signal, presumably caused by an input signal from the instrument, the microcontroller sets OFFSET to a high impedance state, allowing the comparator U2A its maximum sensitivity. Once the signal subsides, the microcontroller sets OFFSET to 0V again, limiting the noise sensitivity of comparator U1A.

Figure 14:
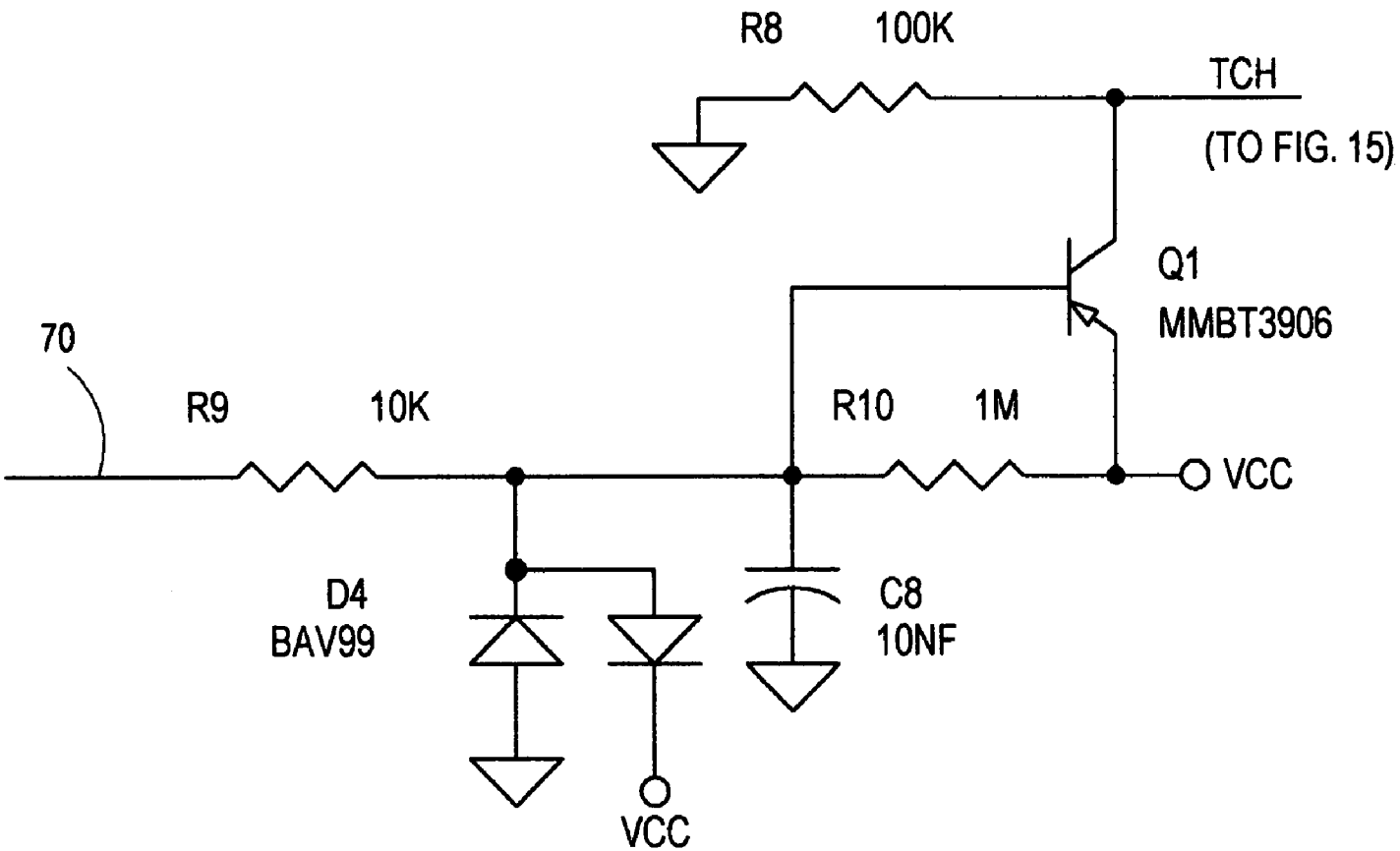
FIG. 14 shows a schematic diagram of the touch sensing amplifier circuit of the preferred embodiment.

FIG. 14 shows the switch amplifier that detects the user's touch on the LED indicator housing 41. Transistor Q1 is configured as a simple common emitter amplifier. The wire 70 is connected to the LED indicator housing 41. When the user touches the indicator housing and some other grounded part of the instrument (such as the guitar strings), the wire 70 allows current to flow from signal VCC (the battery's 95 positive terminal, typically 3 volts) through resistors R10, R9, and the base of Q1 to ground. Capacitor C8 reduces noise susceptibility and dual series-connected diode D4 clamps elecrosttic transients. PNP transistor Q1 then causes a high logic level to appear across resistor R8 at signal TCH. This signal is connected directly to the microcontroller 97 and serves to cause it to change the power state of the tuner circuitry through software actions.

An important point is that the circuit of FIG. 14 is also functional with a mechanical or magnetically operated switch connected between wire 70 and the ground reference of the tuner.

Figure 15:
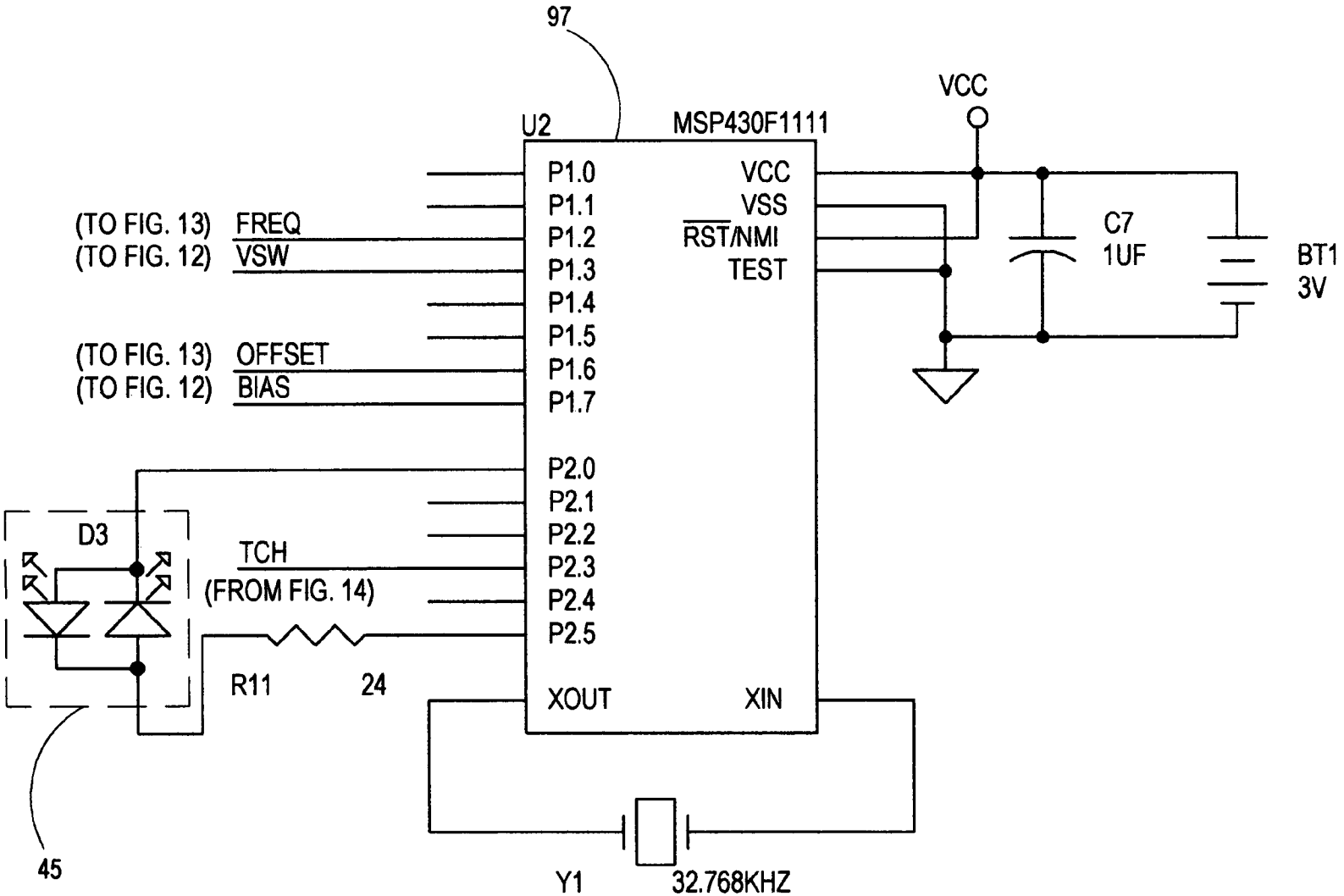
FIG. 15 shows a schematic diagram of the microcontroller circuit of the preferred embodiment.

The microcontroller 97 is shown in FIG. 15. It is a model MSP430 type, but could be any of a number of low power, small microcontrollers. Signals FREQ, TCH (both being microcontroller inputs), OFFSET, BIAS, and VSW (all being microcontroller outputs) have been described previously.

The timebase for the tuner is a 32.768 KHz crystal, Y1. This device is not high enough in frequency to permit high resolution determination of musical note frequencies, but the microcontroller has a higher frequency oscillator built in. This oscillator is not accurate, but is measurable and may be calibrated using the crystal oscillator, and thus the microcontroller can run at higher frequencies than the crystal while maintaining good accuracy. This oscillator calibration operation is performed in software and is a well known technique. Since all frequencies used in this design are less than 1.705 MHz, and the tuner does not have provision for operating from the AC power line, an exemption from testing in FCC rules 47 CFR 15 may be taken advantage of to avoid EMC testing and regulatory cost. Most tuners use a 4 MHz crystal and must bear the cost and delay of such testing.

The battery BT1 is connected directly to the microcontroller, which has low power modes of operation that permit it to shut down until awakened by the TCH signal (coming indirectly from the user). Capacitor C7 is a power supply noise filter component.

The display of the tuner is implemented by an LED 45. Resistor R11 serves as a current limiting resistor. This LED may be driven with current in either direction, lighting either the red or green diode (colors not shown), by reconfiguring microcontroller ports P2.0 and P2.5 with complementary logic signals. Setting ports P2.0 and P2.5 both low or high turns off the LED.

Note that this embodiment does not make provision for muting the instrument's signal while tuning, which some musicians prefer. An electronic or mechanical relay would have to be placed in series with the signal to implement this feature. This is not part of this embodiment because of the increase in space and cost.

Software Flowchart of All Embodiments

Figure 16:
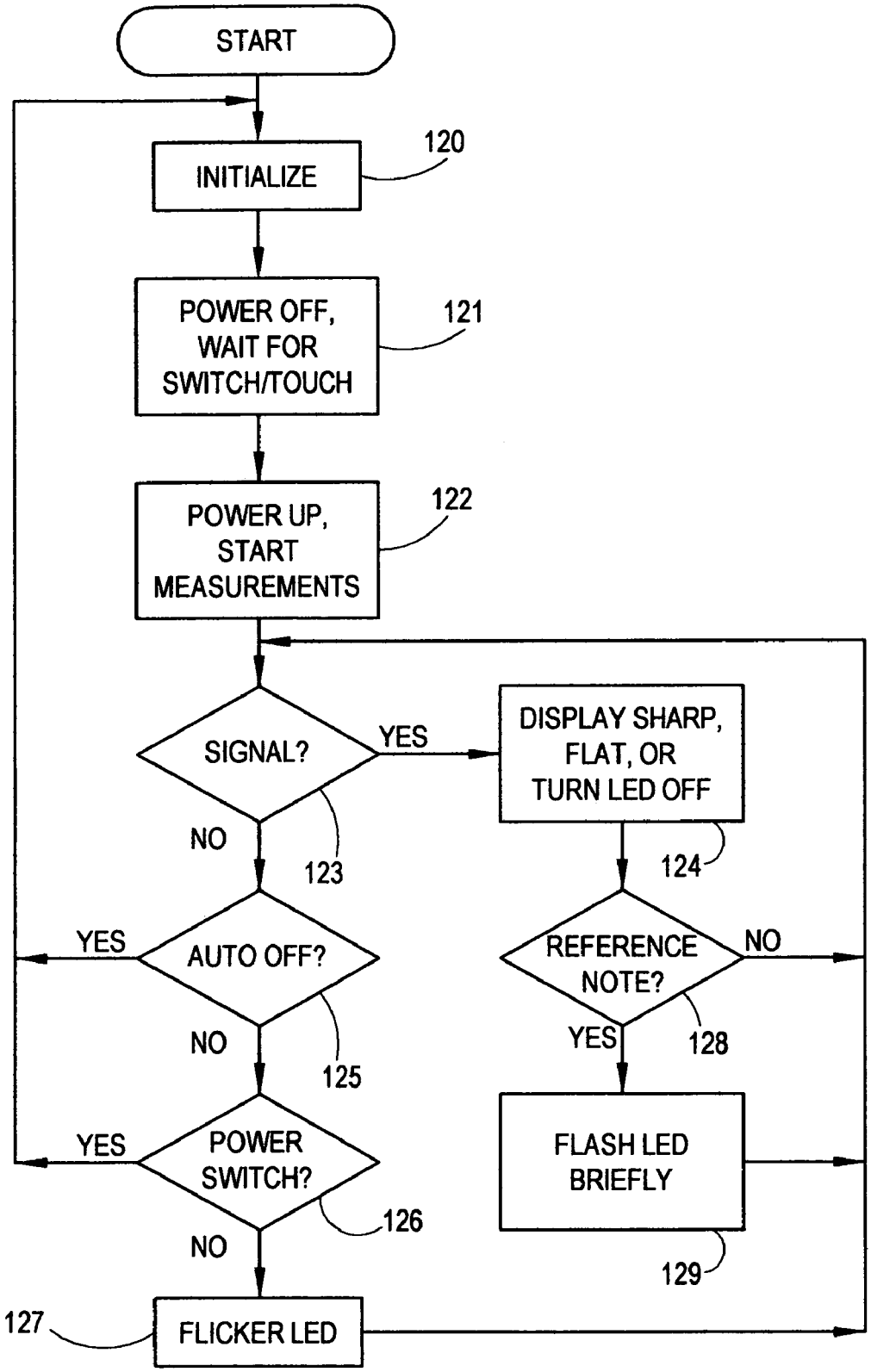
FIG. 16 shows a flowchart of the software program of the preferred embodiment.

FIG. 16 shows the block diagram of the software program for all embodiments. While the physical configuration may change per embodiment, the software conforms to this flowchart. The software of the improved musical instrument tuner is implemented in a commodity microcontroller whose general function is well known to persons practicing in the art.

An initialization block 120 initializes all the registers and systems within the microcontroller, including the input/output lines previously described on the schematic.

Another block 121 powers off the tuner circuitry and waits for the user to turn the tuner on. In this block, signal TCH (see FIG. 15) is configured as an interrupt-sensitive input to detect user activations of the on/off function (by touching LED housing 41 or activating a mechanical switch in an alternative embodiment). Signal OFFSET (see FIG. 15) is set low to desensitize comparator U1A (see FIG. 13). Signals BIAS and VSW (see FIG. 15) are set low to turn off the amplifier U1B (see FIG. 12) and comparator U1A to conserve power.

If the embodiment's hardware makes provision for muting the instrument's audio signal during tuning, then the mute circuitry is disengaged to unmute the signal and let the instrument operate normally. This issue is addressed further in the discussion of the alternate embodiment.

In block 121 of the flowchart, the tuner is considered to be in the power state of off. In all other blocks, the tuner is considered to be in the power state of on.

When the user touches the tuner's LED housing 41 (or activates a mechanical switch in an alternative embodiment), the program falls through to block 122 which prepares the tuner for operation. The microcontroller input FREQ is configured to measure the frequency of the amplified and thresholded signal from the instrument. Signal VSW is set high to turn on amplifier U1B and comparator U1A. After several milliseconds, signal BIAS is set high to bias amplifier U1B in its linear range, with a gradual, pulse width modulated increase over a several tens of millisecond period so as not to emit voltage transients into the audio signal through capacitor C3. The microcontroller's internal oscillator is calibrated in block 122 using the external crystal, Y1 (See FIG. 15). If the embodiment's hardware makes provision for muting the instrument's audio signal during tuning, then the mute circuitry is engaged to mute the signal.

The main program loop passes through block 123 which determines if a note is being played by the instrument, that note arriving at the microcontroller via the signal FREQ. This is done by judging the periodic character of the waveform and is a technique well known in the art. If no note has been detected for a period of time (some hundred milliseconds for example), block 123 determines that no valid note is present and takes the NO branch.

If a valid note is present, block 124 is invoked to control the LED accordingly, displaying either a sharp or flat indication (but no in-tune indication), or turning off the LED entirely if the note is not within plus or minus 50 cents of a member of the set of musical notes recognized by the tuner. These limits correspond to two frequencies 28 and 29 in FIG. 3B. Overshoot compensation (or dynamic overshoot compensation, as required) is performed in block 124.

Block 123 uses a stored table of frequencies and musical notes for selecting a predetermined frequency that it uses to compare against the sensed note. If the user plays a different note, a new predetermined frequency is searched out using the table. This predetermined frequency may be overshoot compensated, as described previously.

Block 128 determines if the signal being detected is the predetermined reference frequency (for example, an E on a guitar). The selection of the predetermined reference frequency is programmed into the tuner. If this frequency is detected, the LED 45 is flashed briefly by block 129. This flashing lasts for only a short period of time amounting to a few hundred milliseconds so as not to confuse the user or foul the measurement with interference caused by a continuously pulsing indicator. It is unnecessary to provide a continuous indication of predetermined reference frequency detection, but only a brief indication when the note is first played. The flashing may, as an example without loss of generality, be an on/off or bicolor toggle of 50 milliseconds per state, six states total, for a cumulative duration of 300 milliseconds.

Block 128 also contains logic to determine if the predetermined reference frequency is being played for the first time since the tuner has been powered, or the first time since any other note has been heard. In either case, block 129 is executed, else the flashing sequence is skipped. This logic is present so that a user playing the predetermined reference frequency repeatedly will not be annoyed with continuous flashing of the LED.

Kaufman teaches a reference frequency function using a vibrating indicator with multiple continuous or intermittent vibration rates, and this has distinct disadvantages. First, having two or more continuous vibratory frequencies is complicating to the function of the tuner because it requires at least a two-level motor speed control. The added complication amounts to wasted space, power and cost. The improved musical instrument tuner requires only an on-off control of the indicator, and the invention of Kaufman would benefit from the present technique.

Second, using intermittent vibratory frequencies (as taught by Kaufman) to designate detection of a predetermined reference frequency has the side effect of inducing noise into adjacent electronic circuits. Pulsing a motor-vibrator on and off generates huge current transients which will interfere with sensitive audio circuits if not filtered at the cost of additional components and space. Pulsing the vibrator only at the start of the note would be much better, but Kaufman fails to teach that innovation.

Regarding fidelity of measurement, an important function illustrated by the block diagram of the improved musical instrument tuner is that the signal measurement (in block 123) occurs separated in time from changing the state of the LED indicator (in blocks 124, 127, and 129). This is done to avoid performing frequency measurements near in time to large current changes which cause the battery voltage to rise or fall as the LED or other indicator is turned on and off. It only takes a few milliseconds for the battery voltage to settle after a state change, then frequency measurements may continue. This operation is important because voltage changes on the microcontroller's supply cause its internal clock to drift in frequency, with the potential for inaccurate pitch measurements. Supply voltage changes also affect amplifier U1B and comparator U1A. All indicator state changes are transient in nature and, once they have subsided, the electronic circuitry is free to make measurements with no internally generated indicator switching noise.

If no valid note is detected by block 123, block 125 monitors an automatic turn-off timer which powers the tuner off after about three minutes. This conserves battery life by making it impossible for the tuner to be left powered indefinitely. The duration of this timer is selected depending on the type of instrument the tuner will be used with, considering that it may take a relatively longer or shorter time to tune various instruments.

Also in this execution path is block 126 which monitors user touches to the tuner's LED housing 41 (or activations of a mechanical switch in an alternative embodiment). If such an event is detected, the tuner turns off by returning to block 120.

If none of the decision conditions are true in blocks 123, 125, and 126, block 127 flickers the LED every few seconds to let the user know the tuner is powered and ready. This block may have a null function in the case an indicator is used which is impractical to "flicker" as is done with the LED.

ALTERNATIVE EMBODIMENTS

Figure 10A:
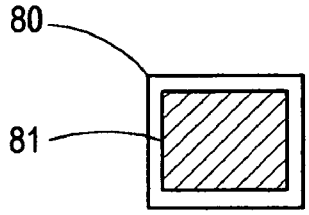
FIG. 10A shows the circuit board of an alternative embodiment.
Figure 10B:
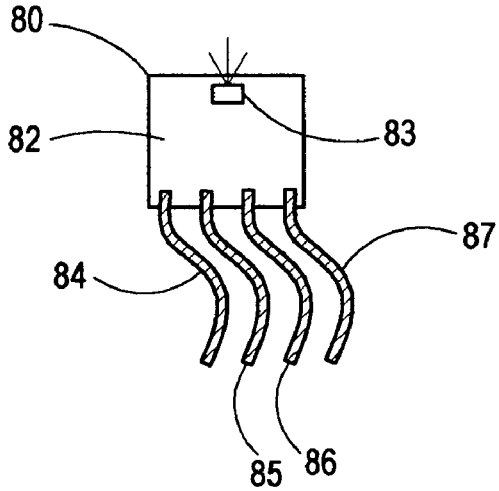
FIG. 10B shows the opposite side view (with reference to FIG. 10A) of the circuit board used in an alternative embodiment.

An alternative embodiment (shown physically in FIG. 10A and 10B) of the improved musical instrument tuner is applicable to instruments where only the tuner need be installed, without carrying any replacement hardware such as the jack plate in the above preferred embodiment. The tuner consists of a small circuit board 80 with attached battery holder 81 for a coin type cell or other suitable battery. The obverse of the circuit board 80 (see FIG. 10B) carries conventional components 82 (not shown in detail), an LED indicator 83, a ground wire 84, a signal connection wire 85 (carrying an electrical signal representative of the musical note, typically from an electrical pickup or microphone external to the tuner), an optional muting signal wire 87, and a touch sensitive signal wire 86 which may be connected to a physical switch or a piece of non-grounded metal on the instrument accessible to the user as an on/off touch control for the tuner.

Optional muting signal wire 87 is muted (signal level reduced to zero) when the tuner is powered. This allows the musician to mute the instrument while tuning so as not to distract or annoy the audience. If this feature is desired, then the signal from the instrument is run through the tuner, via wires 85 and 87. If this feature is not desired, then this wire is left disconnected and the signal connection 85 is used alone.

Figure 10C:
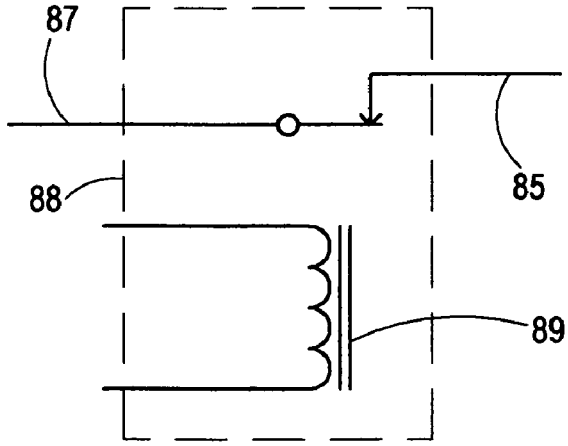
FIG. 10C shows a schematic of a possible muting circuit used in an alternative embodiment.

FIG. 10C shows a schematic of a relay 88 that may be used for this muting function. The normally closed relay contacts act to break the signal path between the wires 85 and 87 when the tuner is powered. The coil 89 of the relay is turned on and off by a conventional microcontroller (not shown) on circuit board 80. This relay may more generally be implemented as a solid state device or any of a number of other signal gates well known in the art, consistent with high fidelity signal transmission.

This embodiment of the invention is applicable to hundreds of models of guitars, both acoustic and electric, and many other types of instruments. The small size of the circuit board (19 mm square and 6 mm thick) allows it to be placed in otherwise wasted space inside the instrument with no discernible increase in weight and no change in tone or appearance.

Several options are available to this embodiment:

1. The indicator 83 may be mounted on the circuit board 80 as shown, or it may be remotely mounted in another part of the instrument (details not shown).
2. The indicator 83 may be mounted integrally on the circuit board 80 as shown and the tuner assembly mounted inside an acoustic or electric guitar or other instrument such that the indicator is visible only to the musician playing the instrument, and not the audience.
3. The on/off control indicated as being wired to the circuit board using wire 86 may be placed on the circuit board as a small switch.
4. The battery power source may be remotely located in another part of the instrument to allow other battery configurations to be used, or the tuner may be powered via a power source external to the instrument, made possible because some instruments receive power through attached cables. Existing batteries in the instrument may also be used to power the tuner.

5. The tuner may obtain the musical signal from the instrument through connection wire 85 (via attachment to a pickup or a potentiometer or to amplifier circuits in the instrument), or via an integral, onboard microphone (not shown), or via an external, off board microphone (not shown). The tuner may supply power to a condenser microphone as needed.

The above options may be used in combination and would have application depending on the instrument being fitted with the improved musical instrument tuner.

Operation of the Tuner

Referring to the preferred embodiment, the user turns on the tuner by touching the indicator light housing 41 while holding the guitar strings or other grounded metal on the instrument. Since the jack plate in the preferred embodiment is grounded, a finger contacting both the light housing and the jack plate will turn the tuner on or off.

After being powered, the tuner starts blinking its LED 45 periodically to indicate that it is ready. The user plucks a string. The tuner determines what note is being played and if the note is in the set E, A, D, G, B, the tuner lights the LED 45 solidly indicating whether the note is sharp or flat. The user detunes the string flat (regardless the initial display indication), then tunes it slowly in the sharp direction until the LED 45 changes state. If the user plays a note of the predetermined reference frequency (for example, E), the tuner shows a special blinking display indication on the LED for a brief period of time to let the user know that the reference frequency has been heard.

It is a common rule of thumb to tune guitar and bass strings from flat to sharp. (For example, Long, et al., cited previously, teaches this.) Tuning this way places increasing tension on the string and overcomes static friction and backlash in the tuning peg, bridge and nut. Tuning from sharp to flat can allow static friction to make the string or mechanism stick, and if that tension is released later (the string or tuning gear slips) then the string will go noticeably flat. The improved musical instrument tuner is compatible with proper string tuning, from a flat condition and moving up in pitch until the indicator changes state.

Once all strings have been tuned, the user touches the indicator light housing 41 again to turn the tuner off. If the user does not turn off the tuner, it turns off automatically after a few minutes.

CONCLUSION

The improved musical instrument tuner exhibits structure and function that is unique among the prior art in that it uses a novel display that shows only SHARP and FLAT indications regarding the sensed musical note, with no ambiguous in-tune window. This innovation, with dynamic overshoot compensation, allows the user to tune an instrument more accurately than prior art tuners with in-tune indicators, and presents a lower cost, lower power, lower weight, and smaller design. The reduction in display size allows the tuner to be used in places where no tuner would before fit, without permanent modification to vintage instruments in aftermarket installation situations. The touch sensitive on/off function removes the need for a mechanical switch and opens up options for an easier, less visually obtrusive installation.

The specific configuration of the embodiments discussed should not be construed to limit implementation of this invention to those embodiments only. The techniques outlined are applicable to embodiments in other physical formats, using different power sources, using single or multiple audio sensors (or connections), using single or multiple jacks or other connectors, using other display technologies, colors or formats, using analog or digital processing techniques, implementing or simulating or emulating the invention substantially in software, and using other software algorithms. The improved musical instrument tuner is functional with the broad range of instruments used by musicians. The improved musical instrument tuner could also be built into an amplifier, speaker enclosure, carrying case, handheld enclosure, or equipment rack. Therefore, the scope of the invention should be determined not by the embodiments illustrated, but by the appended claims and their legal equivalents.

What is claimed is:

1. A musical instrument tuner, which comprises:

(a) a sensing means for sensing a musical note; and (b) a measurement means for measuring a frequency of said musical note; and (c) a selection means for selecting a predetermined lower frequency, a predetermined central frequency, and a predetermined upper frequency, said selection means comprising a stored table of frequencies and musical notes, the lower, central and upper frequencies selected from said stored table as a function of said musical note sensed by said sensing means; and (d) an indicator means for indicating:

an off or inactive indication if said frequency of said musical note is less than said predetermined lower frequency; and an off or inactive indication if said frequency of said musical note is greater than said predetermined upper frequency; and a SHARP indication if said frequency of said musical note is less than or equal to said predetermined upper frequency and greater than or equal to said predetermined central frequency; and a FLAT indication if said frequency of said musical note is greater than or equal to said predetermined lower frequency and less than said predetermined central frequency; and a first indication of a predetermined duration in the case said frequency of said musical note is within a predetermined proximity to a predetermined note of the musical scale with indications for all other notes of the musical scale being different from said first indication, whereby said first indication informs the user that the pitch is near said predetermined note of the musical scale to give the user a point of reference while tuning.

2. The musical instrument tuner of claim 1 wherein said sensing means comprises a connection to an electrical signal representative of said musical note.

3. The musical instrument tuner of claim 1 wherein said sensing means comprises a microphone.

4. The musical instrument tuner of claim 1 wherein said sensing means comprises a microphone integral to said musical instrument tuner.

5. The musical instrument tuner of claim 1 wherein said indicator means comprises an illuminatable element of at least one color.

6. The musical instrument tuner of claim 1 further including a control means for controlling the power state of said musical instrument tuner, said control means comprising a touch sensitive switch, whereby said touch sensitive switch is actuated by the conductivity of the user's skin.

7. The musical instrument tuner of claim 1 further including a control means for controlling the power state of said musical instrument tuner, said control means comprising a mechanical switch.

8. The musical instrument tuner of claim 1 further including a means for muting said musical note when said power state of said musical instrument tuner is on.

9. The musical instrument tuner of claim 1 wherein said selection means selects said predetermined central frequency as one of two frequencies:

a first frequency if said musical note is sharp; and a second frequency if said musical note is flat, whereby said selection provides compensation for overshoot in tuning on the part of the user.

10. A musical instrument tuner, which comprises:

(a) a first means substrate for said musical instrument tuner being comprised of a jack plate, an audio jack being disposed on said first means; and (b) a measurement means for measuring a frequency of a musical note, disposed on said first means; and (c) a selection means for selecting a predetermined lower frequency, a predetermined central frequency, and a predetermined upper frequency, said selection means comprising a stored table of frequencies and musical notes, the lower, central and upper frequencies selected from said stored table as a function of said musical note sensed by said sensing means; and (d) an indicator means for indicating:

an off or inactive indication if said frequency of said musical note is less than said predetermined lower frequency; and an off or inactive indication if said frequency of said musical note is greater than said predetermined upper frequency; and a SHARP indication if said frequency of said musical note is less than or equal to said predetermined upper frequency and greater than or equal to said predetermined central frequency; and a FLAT indication if said frequency of said musical note is greater than or equal to said predetermined lower frequency and less than said predetermined central frequency; and a first indication of a predetermined duration in the case said frequency of said musical note is within a predetermined proximity to a predetermined note of the musical scale with indications for all other notes of the musical scale being different from said first indication, whereby said first indication informs the user that the pitch is near said predetermined note of the musical scale to give the user a point of reference while tuning.

11. The musical instrument tuner of claim 10 wherein said sensing means is comprised of at least one connection between said measurement means and said audio jack.

12. The musical instrument tuner of claim 10 wherein said sensing means is comprised of a connection between said measurement means and an electrical signal representative of said musical note external to said musical instrument tuner.

13. The musical instrument tuner of claim 10 further including a control means for controlling the power state of said musical instrument tuner, said control means comprising a touch sensitive switch, whereby said touch sensitive switch is actuated by the conductivity of the user's skin.

14. The musical instrument tuner of claim 10 further including a control means for controlling the power state of said musical instrument tuner, said control means comprising a mechanical switch.

15. The musical instrument tuner of claim 10 further including a means for muting said musical note when said power state of said musical instrument tuner is on.

16. A musical instrument tuner, which comprises:

(a) a sensing means for sensing a musical note; and (b) a measurement means for measuring a frequency of said musical note; and (c) a selection means for selecting a predetermined lower frequency, a predetermined central frequency, and a predetermined upper frequency, said selection means comprising a stored table of frequencies and musical notes, the lower, central and upper frequencies selected from said stored table as a function of said musical note sensed by said sensing means; and (d) an indicator means comprising an illuminatable element of at least one color for indicating:

an off or inactive indication if said frequency of said musical note is less than said predetermined lower frequency; and an off or inactive indication if said frequency of said musical note is greater than said predetermined upper frequency; and a SHARP indication if said frequency of said musical note is less than or equal to said predetermined upper frequency and greater than or equal to said predetermined central frequency; and a FLAT indication if said frequency of said musical note is greater than or equal to said predetermined lower frequency and less than said predetermined central frequency; and a first indication of a predetermined duration in the case said frequency of said musical note is within a predetermined proximity to a predetermined note of the musical scale with indications for all other notes of the musical scale being different from said first indication, whereby said first indication informs the user that the pitch is near said predetermined note of the musical scale to give the user a point of reference while tuning.

17. The musical instrument tuner of claim 16 wherein said sensing means is comprised of a connection between said measurement means and an electrical signal representative of said musical note external to said musical instrument tuner.

18. The musical instrument tuner of claim 16 wherein said sensing means comprises a microphone.

19. The musical instrument tuner of claim 16 further including a means for muting said musical note when said power state of said musical instrument tuner is on.

20. The musical instrument tuner of claim 16 wherein said selection means selects said predetermined central frequency as one of two frequencies:

a first frequency if said musical note is sharp; and a second frequency if said musical note is flat, whereby said selection provides compensation for overshoot in tuning on the part of the user.

* * * * *